US011672736B2

(12) United States Patent
Tian et al.

(10) Patent No.: US 11,672,736 B2
(45) Date of Patent: Jun. 13, 2023

(54) PILL CUTTER AND METHOD FOR USING THEREOF

(71) Applicant: Song Yang, Shanghai (CN)

(72) Inventors: Zexu Tian, Changshu (CN); Hongliang Tian, Changshu (CN); Song Yang, Shanghai (CN)

(73) Assignee: Song Yang, Shanghai (CN)

( * ) Notice: Subject to any disclaimer, the term of this patent is extended or adjusted under 35 U.S.C. 154(b) by 185 days.

(21) Appl. No.: 17/167,748

(22) Filed: Feb. 4, 2021

(65) Prior Publication Data

US 2021/0308013 A1 Oct. 7, 2021

(30) Foreign Application Priority Data

Apr. 7, 2020 (CN) ..... 202010265297.X

(51) Int. Cl.
*A61J 1/03* (2023.01)
*A61J 7/00* (2006.01)

(52) U.S. Cl.
CPC ..... *A61J 7/0007* (2013.01)

(58) Field of Classification Search
CPC ..... A61J 7/0007; B26D 1/26
USPC ..... D24/220
See application file for complete search history.

(56) References Cited

U.S. PATENT DOCUMENTS 3,517,871 A * 6/1970 Gaffney ..... A61J 7/0007 83/648
6,557,945 B1 * 5/2003 Eric ..... A61J 7/0007 30/124
7,093,363 B1 8/2006 Kuo
2003/0005800 A1 * 1/2003 Czarnek ..... A61J 7/0007 83/167
2005/0067452 A1 3/2005 Darst
2009/0019705 A1 * 1/2009 Aby-Eva ..... B26D 7/1818 30/117
2012/0060374 A1 3/2012 Noble et al.
(Continued)

FOREIGN PATENT DOCUMENTS

CN 203227036 U 10/2013
CN 103610593 A 3/2014
(Continued)

OTHER PUBLICATIONS

1st Office Action dated May 7, 2022 of Chinese Application No. 202010265297.X.

(Continued)

*Primary Examiner* — Ghassem Alie
*Assistant Examiner* — Samuel A Davies
(74) *Attorney, Agent, or Firm* — Qinghong Xu

(57) ABSTRACT

A pill cutter and a method for using thereof are provided. The pill cutter includes: a bottom case; a pressing plate provided with a blade and a shield plate provided with a slit. When the pressing plate rotates relative to the bottom case, the blade at least has a protected state and a pill-cutting state, in the protected state, the blade is positioned between the shield plate and the pressing plate after the two plates are separated from each other, and in the pill-cutting state, the blade passes through the slit and reaches the bottom case. The blade can be shielded automatically when the pill cutter is opened for putting the pill in, and safety of using the pill cutter is largely enhanced.

16 Claims, 24 Drawing Sheets

A–A

(56) References Cited

U.S. PATENT DOCUMENTS

| | | | | |
|---|---|---|---|---|
| 2017/0128324 | A1 | 5/2017 | Muller et al. | |
| 2017/0273868 | A1 | 9/2017 | Wang | |
| 2018/0333333 | A1* | 11/2018 | Lee | B26D 7/22 |
| 2019/0060173 | A1 | 2/2019 | Raghuprasad | |

FOREIGN PATENT DOCUMENTS

| | | | |
|---|---|---|---|
| CN | 103610594 | A | 3/2014 |
| CN | 206745627 | U | 12/2017 |
| CN | 206822853 | U | 1/2018 |
| CN | 209337132 | U | 9/2019 |

OTHER PUBLICATIONS

2nd Office Action dated Sep. 26, 2022 of Chinese Application No. 202010265297.X.

* cited by examiner

B–B

A-A

B–B

A-A

A-A

PILL CUTTER AND METHOD FOR USING THEREOF

CROSS-REFERENCE TO RELATED APPLICATIONS

This application is based upon and claims priority to Chinese Patent Application No. 202010265297.X, filed on Apr. 7, 2020, the entire contents of which are incorporated herein by reference.

TECHNICAL FIELD

The present disclosure relates to a medical auxiliary device, and more particularly to a pill cutter and a method for using thereof.

BACKGROUND

"Safety of patients taking medicine" is an important subject for various medical institutions, however, inappropriate dose is a potential risk when the aged and the infants take medicine. Inappropriate dose taken by the aged may occur when the dose or the frequency is higher than a recommended value, and inappropriate dose taken by the infants may occur for the reason that the physiological development of the infants is not very mature and large differences exist between the infants and adults in the aspects of medicine absorption, distribution, metabolism, and excretion. If the medicine is taken in a wrong way, the healing situation will be influenced seriously.

During the treatment and prevention of various diseases, taking medicine or health food (which are both called medicine in the following) is a most direct and effective treating and preventing method. Normally, the medicine and the health food can be taken orally, by injection, or applied externally, etc. Wherein, the oral medicine is a kind of medicine that is easy to preserve and carry, so the oral medicine is a commonly used kind of medicine. The oral medicine has the forms of pills, capsules, powders, etc. The pill is molded to a shape of round, ellipse, or polygon, which is easy to swallow. As the pill is easier to preserve under various external environments, the pill is a most used kind of medicine. Normally, when making up a prescription, different doses are given considering the age, the weight, and the disease severity of different patients, therefore, the pill is needed to be cut into several smaller portions. As the pill is made by pressing, it's very hard. Splitting the pill by fingers needs great effort, and often causes an imprecise dose, which has been a trouble for the user.

The pill can be cut by a pill cutter with a blade and the blade must be very sharp. Therefore, the pill is normally cut by a high-quality metal cutter, which causes a safety problem that the user may be scratched by an exposed blade when putting the pill in the pill cutter. The safety of the pill cutter is reduced.

Besides, the existing pill deblister device and the pill cutter are independent from each other, the user needs to remove the pill and then put the pill in the pill cutter, the integral operation time of cutting the pill is increased, and the possibility of pill contamination is increased, which will cause negative effect to the patients.

SUMMARY

In the present disclosure, a pill cutter for cutting pills is provided, including: a bottom case; a pressing plate, rotatably connected to the bottom case and provided with a blade; and a shield plate, rotatably connected to the bottom case and provided with a slit; wherein, the shield plate is located between the pressing plate and the bottom case, when the pressing plate rotates relative to the bottom case, the pressing plate cooperates with the shield plate, so that the blade at least has a protected state and a pill-cutting state, in the protected state, the blade is positioned between the shield plate and the pressing plate after the pressing plate and the shield plate are separated from each other, and in the pill-cutting state, the blade passes through the slit and reaches the bottom case.

In the present disclosure, a method for using the pill cutter is provided, including the following steps:

rotating to open the pressing plate relative to the bottom case, wherein, as the pressing plate rotates relative to the bottom case, the shield plate is separated from the pressing plate, and the blade is positioned between the shield plate and the pressing plate:

putting at least one pill in the pill cutter; and rotating to close the pressing plate relative to the bottom case, and the blade passes through the slit of the shield plate to cut the pill.

In the present disclosure, a method for using the pill cutter is provided, including the following steps:

rotating to open the pressing plate relative to the bottom case;

putting a pill board in the pill cutter; and rotating to close the pressing plate relative to the bottom case once, the pill deblister column removes a pill from the pill board, then the pill moves through the channel towards the positioning platform and is cut by the fallen blade.

It should be readily understood that both the foregoing general description and the following detailed description are exemplary and explanatory only, and are not intended as a limitation to the scope of the present disclosure.

BRIEF DESCRIPTION OF THE DRAWINGS

The foregoing and other features, and advantages of the invention are apparent from the following detailed description taken in conjunction with the accompanying drawings in which.

DETAILED DESCRIPTION

In the following, embodiments of the present disclosure will be described in detail with reference to the figures. The concept of the present disclosure can be implemented in a plurality of forms, and should not be understood to be limited to the embodiments described hereafter. In contrary, these embodiments are provided to make the present disclosure more comprehensive and understandable, and so the conception of the embodiments can be conveyed to those skilled in the art fully. Same reference signs in the figures refer to same or similar elements, so repeated description of them will be omitted.

Besides, the technical features, assemblies, and characteristics can be combined in any appropriate way in one or more embodiments. In the following, more specific details are provided to give a full understanding to the embodiments of the present disclosure. However, those skilled in the art should realize that the technical proposal can also be realized without one or more of the specific details, or with other assemblies or components. In other conditions, some common assemblies or components well known in the art are not described to avoid making the present disclosure unclear.

Figure 1:
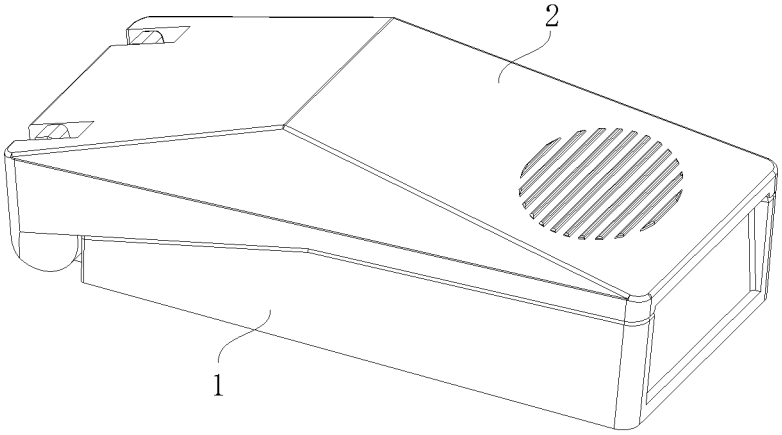
FIG. 1 is a stereogram of a pill cutter of the present disclosure.
Figure 2:
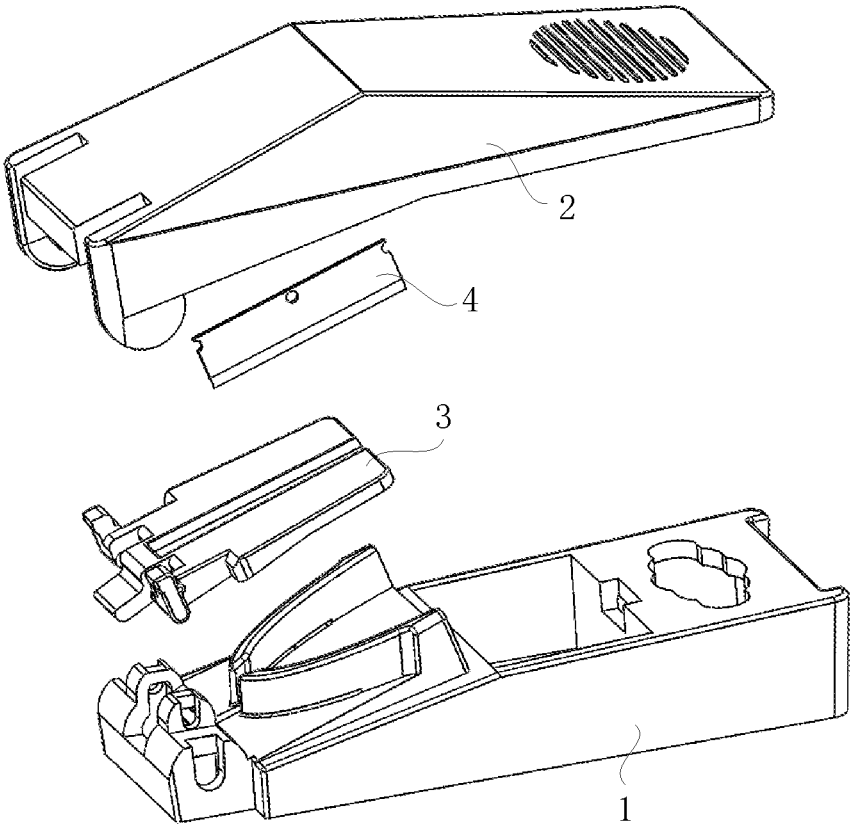
FIG. 2 is decomposition view of the pill cutter of the present disclosure.
Figure 3:
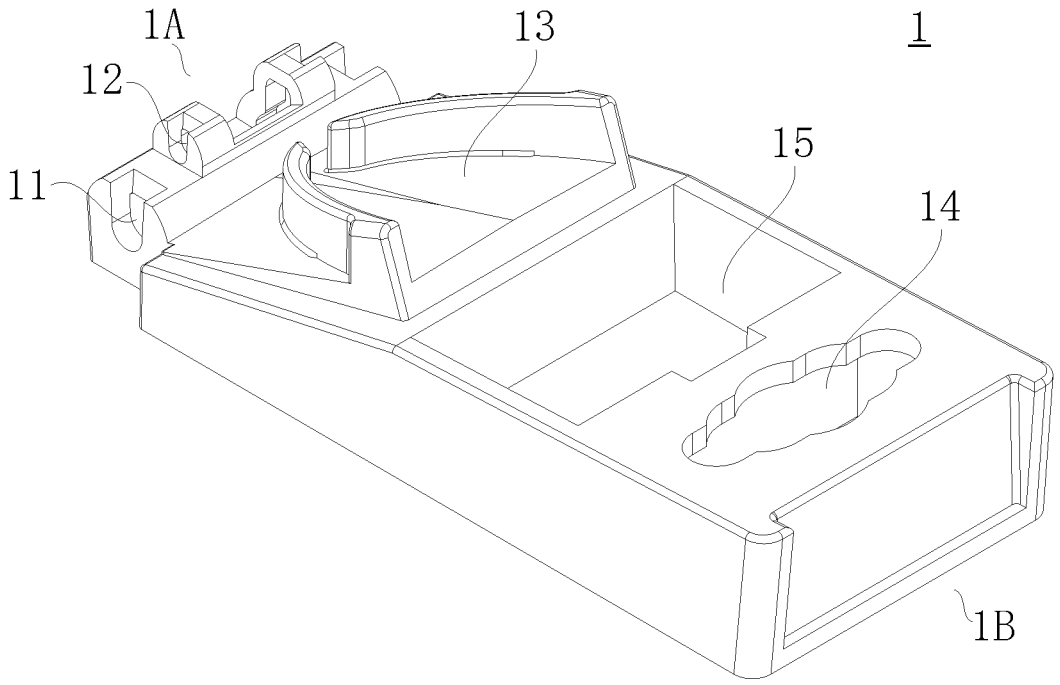
FIG. 3 is a stereogram of a bottom case of the pill cutter of the present disclosure.
Figure 4:
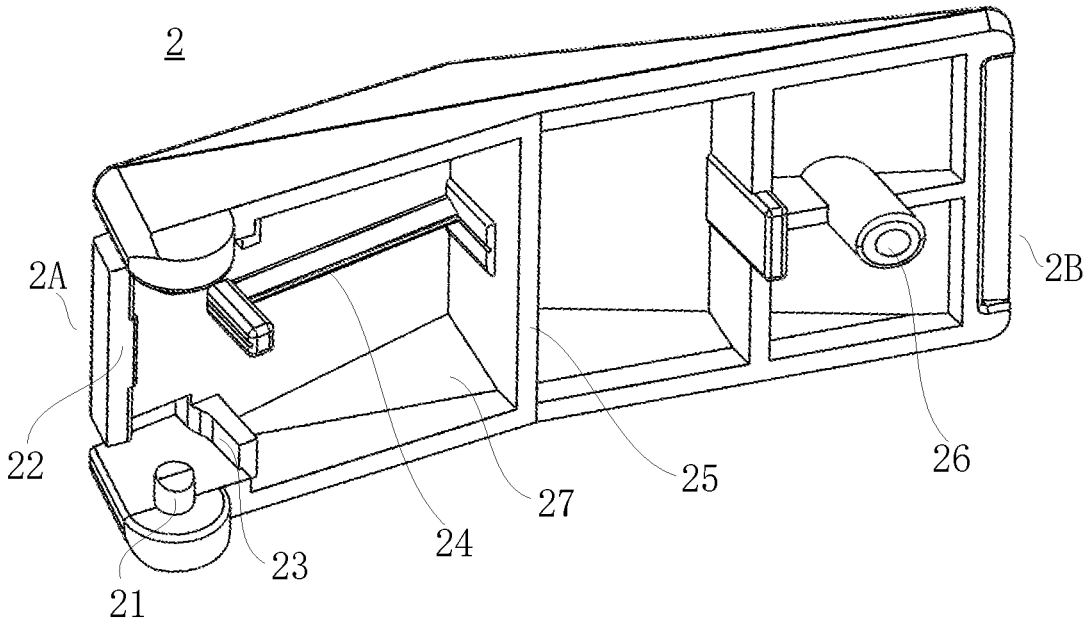
FIG. 4 is stereogram of a pressing plate of the pill cutter of the present disclosure.
Figure 5:
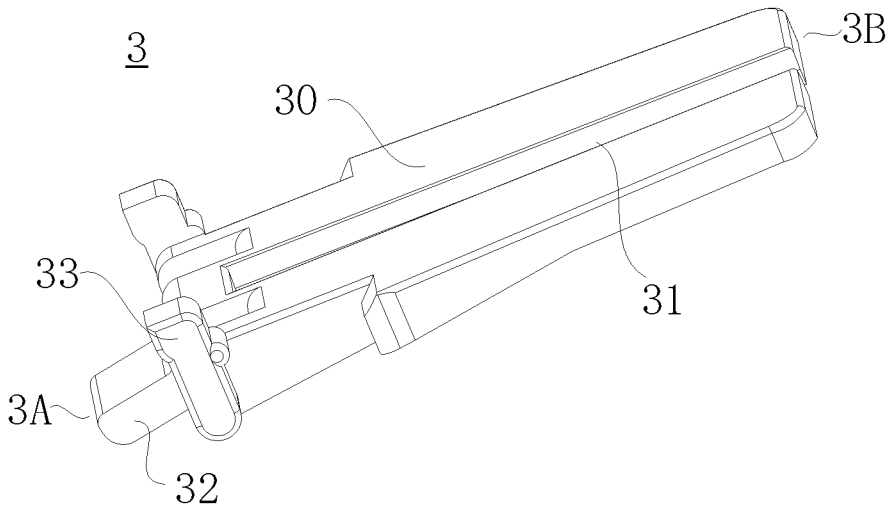
FIG. 5 is a stereogram of a shield plate of the pill cutter of the present disclosure.
Figure 6:
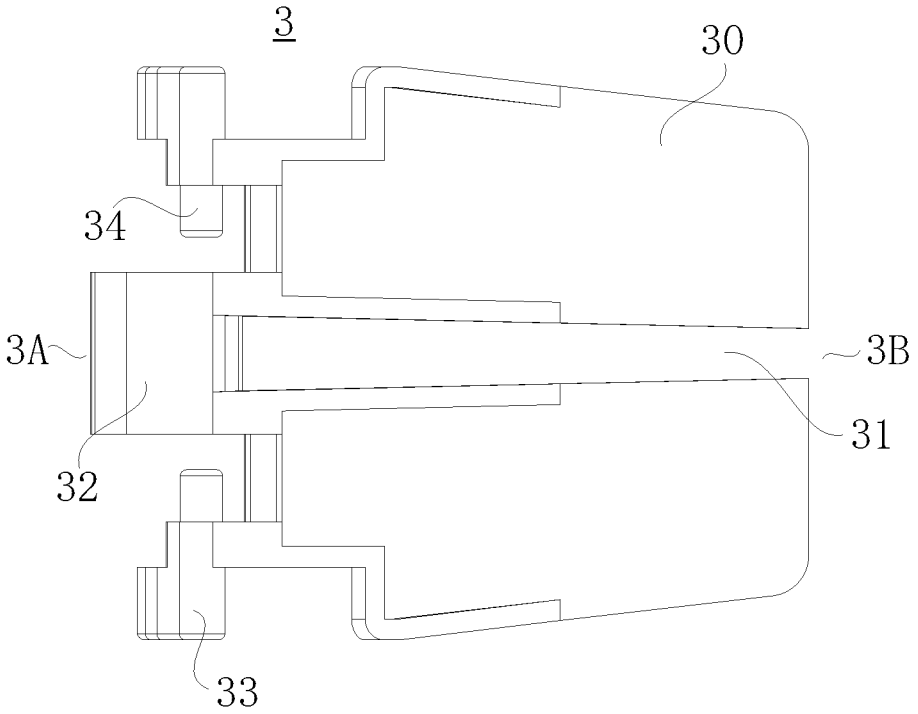
FIG. 6 is top view of the shield plate of the pill cutter of the present disclosure.

FIG. 1 is a stereogram of a pill cutter of the present disclosure. FIG. 2 is decomposition view of the pill cutter of the present disclosure. FIG. 3 is a stereogram of a bottom case of the pill cutter of the present disclosure. FIG. 4 is stereogram of a pressing plate of the pill cutter of the present disclosure. FIG. 5 is a stereogram of a shield plate of the pill cutter of the present disclosure. FIG. 6 is top view of the shield plate of the pill cutter of the present disclosure. As shown in FIGS. 1-6, a pill cutter of the present disclosure includes: a bottom case 1, a pressing plate 2, and a shield plate 3. The pressing plate 2 is rotatably connected to the bottom case 1. A side of the pressing plate 2 facing the bottom case 1 is provided with a blade slot 24, and a blade 4 is mounted in the blade slot 24. The shield plate 3 is rotatably connected to the bottom case 1 and provided with a slit 31. The shield plate 3 is located between the pressing plate 2 and the bottom case 1 and includes a shield plate body 30. When the pressing plate 2 rotates relative to the bottom case 1, the pressing plate 2 cooperates with the shield plate 3, so that the blade 4 at least has a protected state and a pill-cutting state. In the protected state, the blade 4 is positioned between the shield plate 3 and the pressing plate 2 after the pressing plate 2 and the shield plate 3 are separated from each other, and in the pill-cutting state, the blade 4 passes through the slit 31 of the shield plate 3 and reaches the bottom case 1. Therefore, when the pill cutter is opened, the shield plate 3 can be used for shield the blade 4 automatically during the rotation process of the pressing plate 2 to prevent the blade 4 from being exposed in the protected state, and in the pill-cutting state, the blade 4 can pass through the shield plate 3 to cut the pills.

When the pressing plate 2 rotates, the shield plate doesn't always rotate together with the pressing plate. When the pressing plate 2 rotates relative to the bottom case, the pressing plate 2 cooperating with the shield plate 3 includes the pressing plate 2 rotating alone while the shield plate 3 staying static relative to the bottom case 1 in a first cooperation state and the shield plate 3 rotating together with the pressing plate 2 in a second cooperation state. Therefore, no matter in the opening process or in the closing process for cutting the pills, the pressing plate 2 and the shield plate 3 doesn't always rotate together. During the whole opening process or the whole closing process, the pressing plate 2 and the shield plate 3 have a first cooperation state that the shield plate 3 doesn't rotate together with the pressing plate 2 and a second cooperation state that the shield plate 3 rotates together with the pressing plate 2.

When the pressing plate 2 rotates alone relative to the bottom case 1 and a rotation angle of the pressing plate 2 is smaller than a preset angle, the shield plate 3 stays static relative to the bottom case, that is, the shield plate 3 and the pressing plate 2 are in the first cooperation state. When the pressing plate 2 rotates alone relative to the bottom case 1 and the rotation angle of the pressing plate 2 is larger than or equal to the preset angle, the pressing plate 2 abuts and drives the shield plate 3, the pressing plate 2 and the shield plate 3 rotate synchronously and respectively around two different rotating shafts, that is, the shield plate 3 and the pressing plate 2 are in the second cooperation state. In the second cooperation state, the pressing plate 2 and the shield plate 3 rotate around two different rotating shafts at a same rotation velocity, but the present disclosure is not limited to this. As the pressing plate 2 and the shield plate 3 rotate synchronously and respectively around two different rotating shafts, a first space 5 is formed between the pressing plate 2 and the shield plate 3, and the blade 4 in the protected state is integrally accommodated in the first space 5, or a second space 6 is formed between the shield plate 3 and the bottom case 1, at least a part of the blade 4 in the pill-cutting state enters the second space 6 from the first space 5 through the slit 31. But the present disclosure is not limited to this.

A first pivoting portion 11 and a second pivoting portion 12 are provided on a first end 1A of the bottom case 1. A first end 2A of the pressing plate 2 is rotatably connected to the first pivoting portion 11 through a first rotating shaft 21. The first end 2A of the pressing plate 2 is provided with a second driving portion 23. A first end 3A of the shield plate 3 is rotatably connected to the second pivoting portion 12 through a second rotating shaft 34. The first end 3A of the shield plate 3 is provided with a second contacting portion 33. During a second rotation stage of the pressing plate 2 relative to the bottom case 1, the second driving portion 23 abuts the second contacting portion 33 to drive the shield plate 3 to rotate around the second rotating shaft 34. In the pill-cutting state, a second gap D is formed between the second driving portion 23 and the second contacting portion 33. As the rotation angle of the pressing plate 2 relative to the bottom case 1 increases, the second gap D decreases until the second driving portion 23 abuts the second contacting portion 33, but the present disclosure is not limited to this. The bottom case 1 is further provided with a pill container 15 for storing the pill, but the present disclosure is not limited to this.

A first end 2A of the pressing plate 2 is further provided with a first driving portion 22, the first driving portion 22 is closer to first end 2A of the pressing plate 2 than the second driving portion 23. The first end 3A of the shield plate 3 is further provided with a first contacting portion 32, the first contacting portion 32 is closer to the first end 3A of the shield plate 3 than the second contacting portion 33. During a first rotation stage different from the second rotation stage in time sequence, the first driving portion 22 abuts the first contacting portion 32 to drive the shield plate 3 to rotate around the second rotating shaft 34. The angle between the pressing plate 2 and the bottom case 1 during the first rotation stage is smaller than the angle between the pressing plate 2 and the bottom case 1 during the second rotation stage. In the pill-cutting state, a first gap C is formed between the first driving portion 22 and the first contacting portion 32, during an initial rotation process of the pressing plate 2, as the first gap C exists, the first driving portion 22 is not in contact with the first contacting portion 32, the pressing plate 2 rotates alone and the shield plate 3 stays static. As the rotation angle of the pressing plate 2 relative to the bottom case 1 increases, the first gap C decreases, until the first driving portion 22 abuts the first contacting portion 32. At this time, the pressing plate 2 can drive the shield plate 3 to rotate synchronously, to realize a transformation between the first rotation stage and the second rotation stage. But the present disclosure is not limited to this. When the second driving portion 23 abuts the second contacting portion 33, the first driving portion 22 and the first contacting portion 32 are separated from each other. Or, when the first driving portion 22 abuts the first contacting portion 32, the second driving portion 23 and the second contacting portion 33 are separated from each other. The pressing plate 2 can continue driving the shield plate 3 to rotate synchronously (but with a contacting portion different from the above), until the pill cutter is completely opened. In this embodiment, the first rotation stage and the second rotation stage have two different time ranges, and the time range of the first rotation stage is before the time range of the second rotation stage in time sequence. Wherein, the first rotation stage is a stage when the pressing plate 2 is just separated from the bottom case 1 and the rotation angle of the pressing plate 2 is in a smaller angle range, the second rotation stage is a stage when the pressing plate 2 continues rotating relative to the bottom case 1 and the rotation angle of the pressing plate 2 increases to a larger angle range. For example, during the first rotation stage, the angle between the pressing plate 2 and the bottom case 1 is within a smaller angle range of 0°-30°, during the second rotation stage, the angle between the pressing plate 2 and the bottom case 1 is within a large angle range of 31°-80°. But the present disclosure is not limited to this. The two groups of the driving components (a first group: the first driving portion 22 and the first contacting portion 32, a second group: the second driving portion 23 and the second contacting portion 33) are used to satisfy the largest opening angle of the pill crusher, and provide a damping for keeping the largest opening angle of the pill cutter in the protected state, so that the pill cutter is easier to be kept at this state. The two groups of the driving components are also used to satisfy the rigidity required for cutting the pills in the pill-cutting state, but the present disclosure is not limited to this.

In an alternative embodiment (not shown in the figures), the first rotation stage and the second rotation stage can also be realized only by a third driving portion of the pressing plate, a third contacting portion of the shield plate (the pressing plate no longer includes the first driving portion and the second driving portion, and the shield plate no longer includes the first contacting portion and the second contacting portion), and a third gap between the third driving portion and the third contacting portion. Wherein, during the first rotation stage, the pressing plate rotates alone, as the third gap exists, the third driving portion moves and is not in contact with the third contacting portion. When the third driving portion moves to be in contact with the third contacting portion, the second rotation stage begins, and the pressing plate rotates with the shield plate synchronously, but the present disclosure is not limited to this.

The slit 31 extends from the second end 3B of the shield plate 3 departing from the rotating shaft of the shield plate 3 towards the first end 3A. The second end 2B of the pressing plate 2 departing from the rotating shaft of the pressing plate 2 is provided with a pill deblister column 26. The second end 1B of the bottom case 1 departing from the rotating shaft is provided with a pill deblister hole 14 used for the pill deblister column 26 going through. The bottom case 1 is further provided with a channel 16, the channel 16 connects a lower part of the pill deblister hole 14 to a positioning platform 13. In a preferable embodiment, the channel 16 inclines from the lower part of the pill deblister hole 14 towards the positioning platform 13, to guide the pills to move towards the positioning platform 13. Therefore, the pill deblister operation and the pill-cutting operation are unified, and can be accomplished by one closing action, contact opportunities between the user and the pill are largely reduced. In the embodiment, the positioning platform 13 supports the pills and limits the positions of the pills using its side wall, but the present disclosure is not limited to this.

Figure 7:
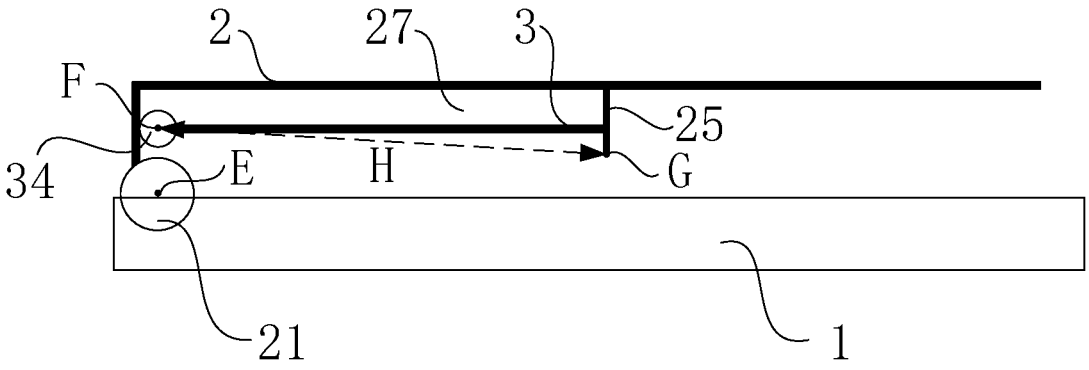
FIG. 7 is a schematic view of the pill cutter in a pill-cutting state of the present disclosure.
Figure 8:
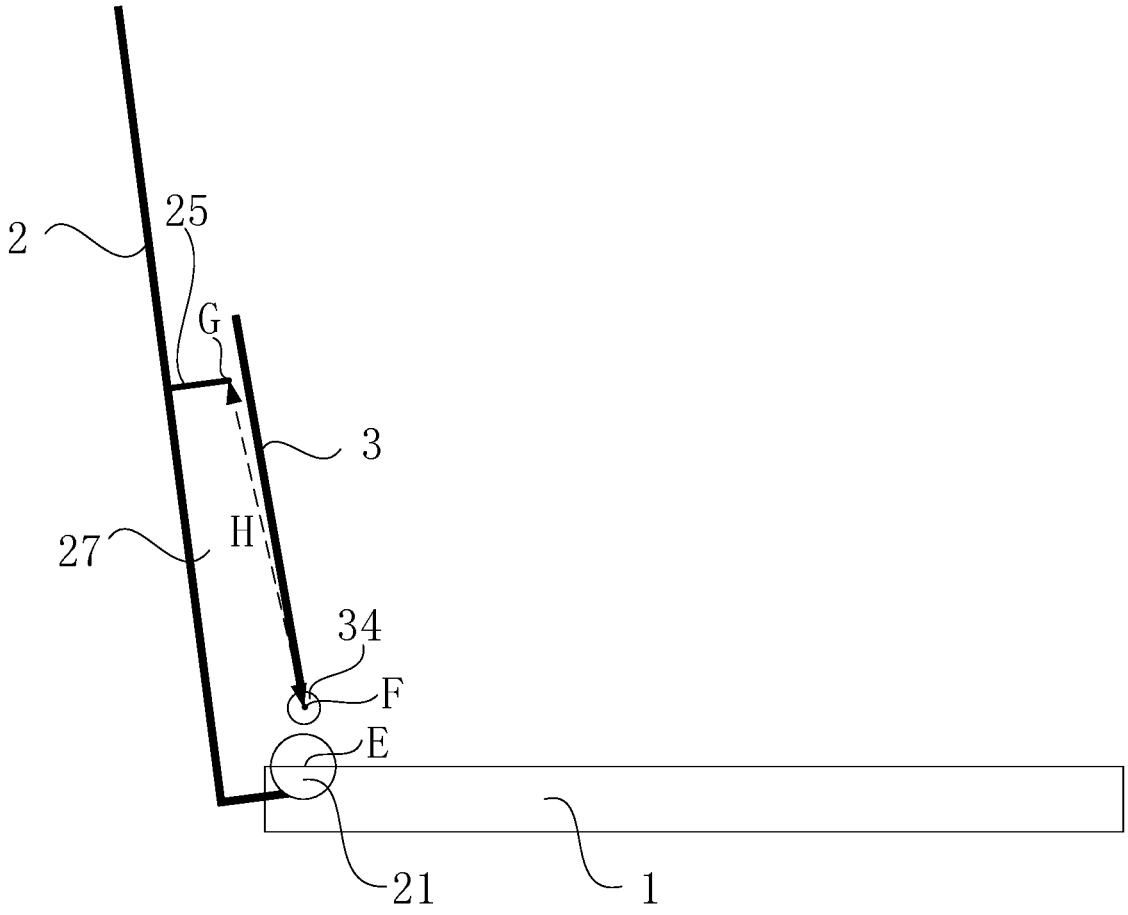
FIG. 8 is schematic view of the pill cutter in a protected state of the present disclosure.

FIG. 7 is a schematic view of the pill cutter in a pill-cutting state of the present disclosure. FIG. 8 is schematic view of the pill cutter in a protected state of the present disclosure. As shown in FIG. 7 and FIG. 8, the pressing plate 2 is provided with a side wall 25, the side wall 25 and at least a part of the pressing plate 2 together form an accommodation slot 27 for accommodating the shield plate 3 in the pill-cutting state. The accommodation slot 27 has a slot opening and an end portion G. The end portion G is a furthest portion of the slot opening from a rotating shaft of the pressing plate 2. That is, the end portion G has a larger distance from the rotating shaft of the pressing plate 2 than other portions of the slot opening. An effective opening length of the accommodation slot 27 is a distance H from the end portion G to an axle center of a rotating shaft of the shield plate 3. When the effective opening length is larger than a length of the shield plate 3, the shield plate 3 is capable of passing through the slot opening to enter or exit from the accommodation slot 27. During at least a part of the rotation process of the pressing plate 2 relative to the bottom case 1, as the rotation angle of the pressing plate 2 relative to the bottom case 1 increases, the distance H decreases, that is, the effective opening length decreases. In the protected state, the distance H between the end portion G and the axle center F of the rotating shaft of the shield plate 3 is smaller than the length of the shield plate 2, that is, the effective opening length is smaller than the length of the shield plate 3, the end portion G blocks the shield plate 3 from returning to the accommodation slot 27. As the shield plate 3 cannot return to the accommodating slot 27, the blade (not shown in FIG. 7 and FIG. 8) won't be exposed from the slit 31. The axle center F of the second rotating shaft 34 is located within an area centered on the axle center E of the first rotating shaft 21, and a radius of the area is equal to a distance from the end portion G of the slot opening of the accommodation slot 27 furthest from the rotating shaft of the pressing plate 2 and the first rotating shaft 21. But the present disclosure is not limited to this. The pressing plate 2 and the shield plate 3 rotate around two different rotating shafts, respectively, the position of the accommodation slot 27 relative to the shield plate 3 can be changed. Based on the preset sizes, the first space 5 is larger than the blade 4. Therefore, when the pill cutter is opened, the blade 4 is in the protected state, the end portion G blocks the shield plate 3 from returning to the accommodating slot 27. The blade 4 is integrally accommodated in the first space 5 formed between the pressing plate 2 and the shield plate 3. The shield plate 3 isolates the first space 5 and the second space 6, the use's hand puts the pills only in the second space 6, can't touch the blade 4 accommodated in the first space 5, and won't get hurt by the blade 4 accommodated in the first space 5 at all.

Figure 9:
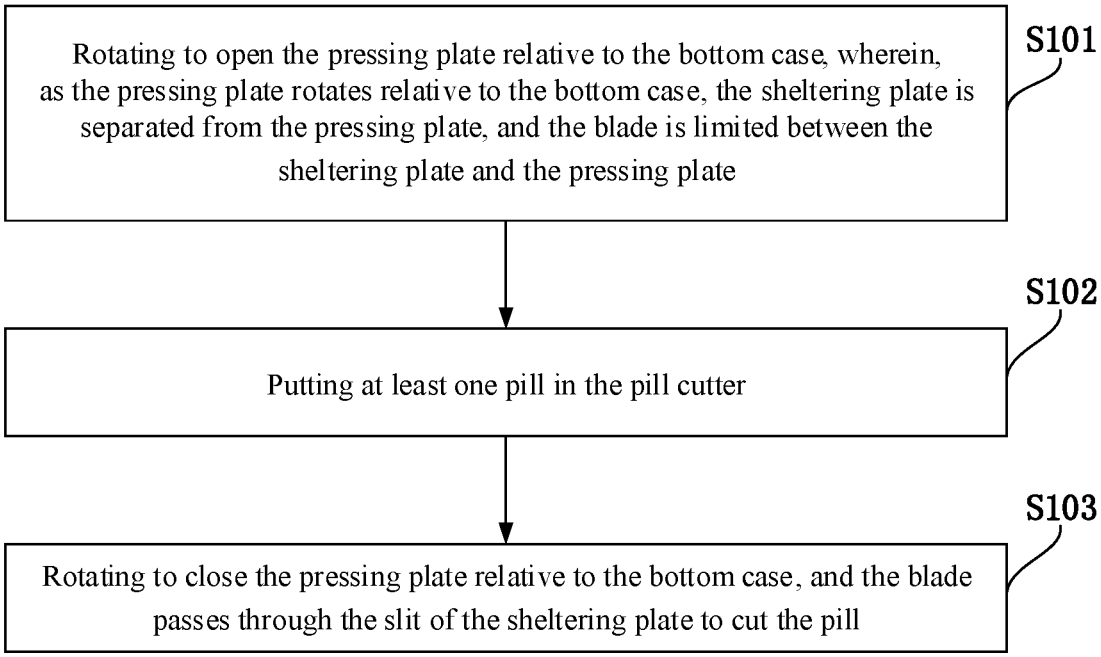
FIG. 9 is a flow chart of a method for using the pill cutter of the present disclosure.

FIG. 9 is a flow chart of a method for using the pill cutter of the present disclosure. As shown in FIG. 9, the method for using the pill cutter of the present disclosure includes the following steps:

S101: rotating to open the pressing plate relative to the bottom case, wherein, as the pressing plate rotates relative to the bottom case, the shield plate is separated from the pressing plate, and the blade is positioned between the shield plate and the pressing plate:

S102: putting at least one pill in the pill cutter; and

S103: rotating to close the pressing plate relative to the bottom case, and the blade passes through the slit of the shield plate to cut the pill.

By using the method of the present disclosure, the blade can be accommodated between the shield plate and the pressing plate when the pill is put in the opened pill cutter, to prevent the blade from being exposed and scratching the user.

Figure 10:
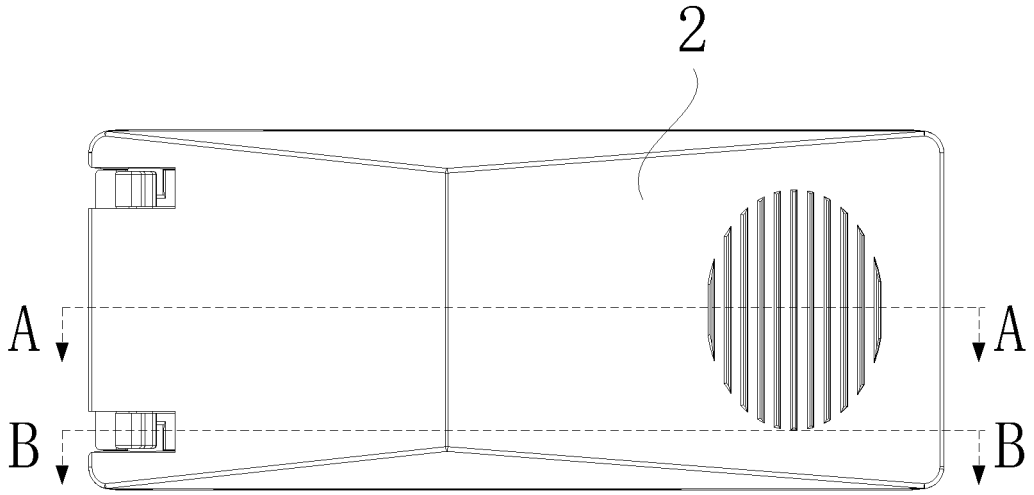
FIG. 10 is top view of the pill cutter of the present disclosure.
Figure 11:
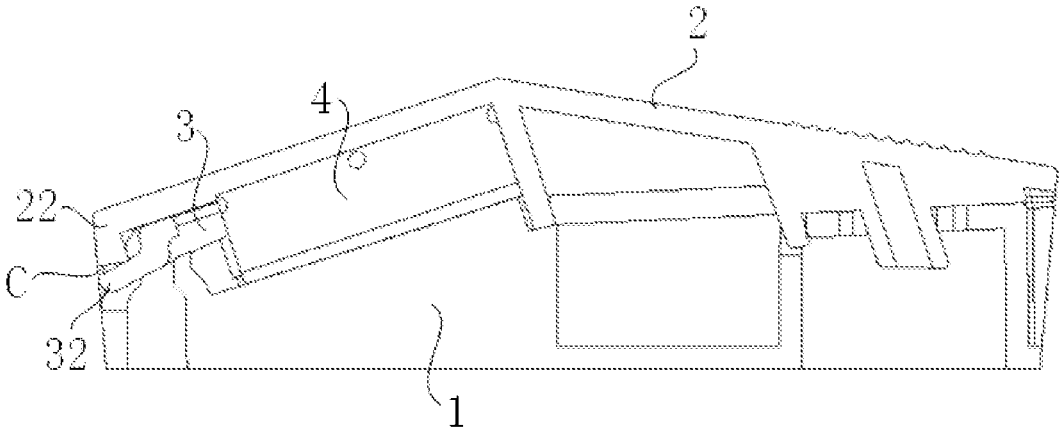
FIG. 11 is a section view along a section line A-A in FIG. 10 of the pill cutter in the pill-cutting state.
Figure 12:
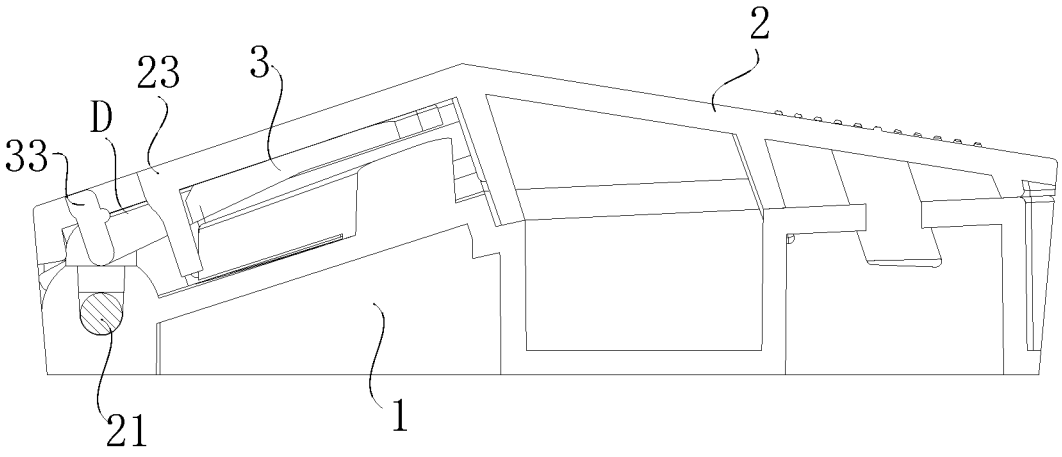
FIG. 12 is a section view along a section line B-B in FIG. 10 of the pill cutter in the pill-cutting state.

In the following, the specific process of the method for using the pill cutter is described by combining FIGS. 10-18. FIG. 10 is top view of the pill cutter of the present disclosure. FIG. 11 is a section view along a section line A-A in FIG. 10 of the pill cutter in the pill-cutting state. FIG. 12 is a section view along a section line B-B in FIG. 10 of the pill cutter in the pill-cutting state. As shown in FIGS. 10-12, in the pill-cutting state, the shield plate 3 can enter the accommodating slot 27, so that the blade 4 on the pressing plate 2 passes through the slit 31 of the shield plate 3 to reach the bottom case 1. The pressed-down shield plate 3 contributes to cooperating with the positioning platform 13 to clamp the pill. The first gap C exists between the first driving portion 22 and the first contacting portion 32, and the second gap D exists between the second driving portion 23 and the second contacting portion 33.

Figure 13:
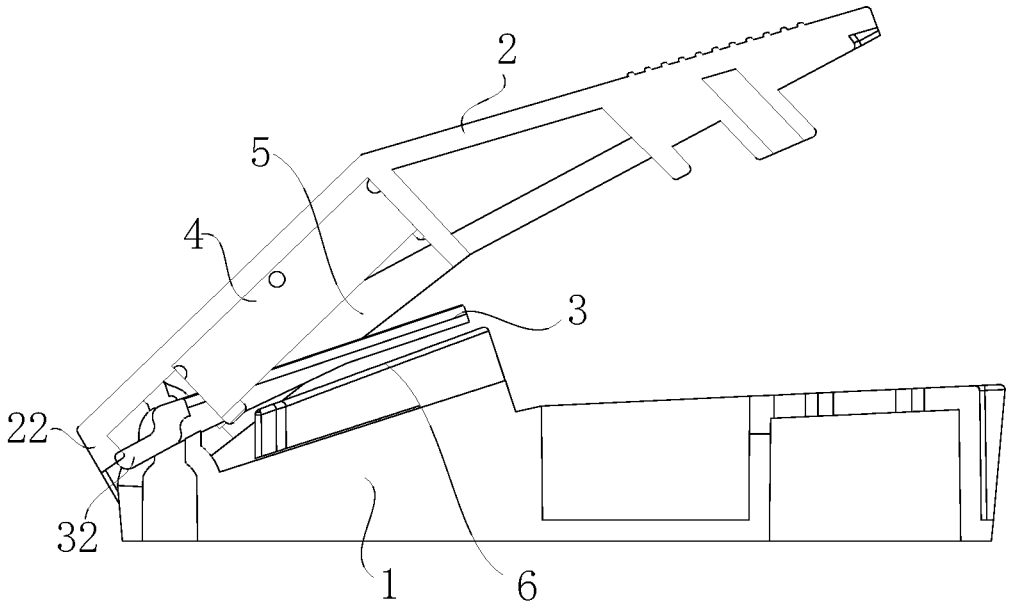
FIG. 13 is a section view along a section line A-A in FIG. 10 of the pill cutter in a first rotation stage.
Figure 14:
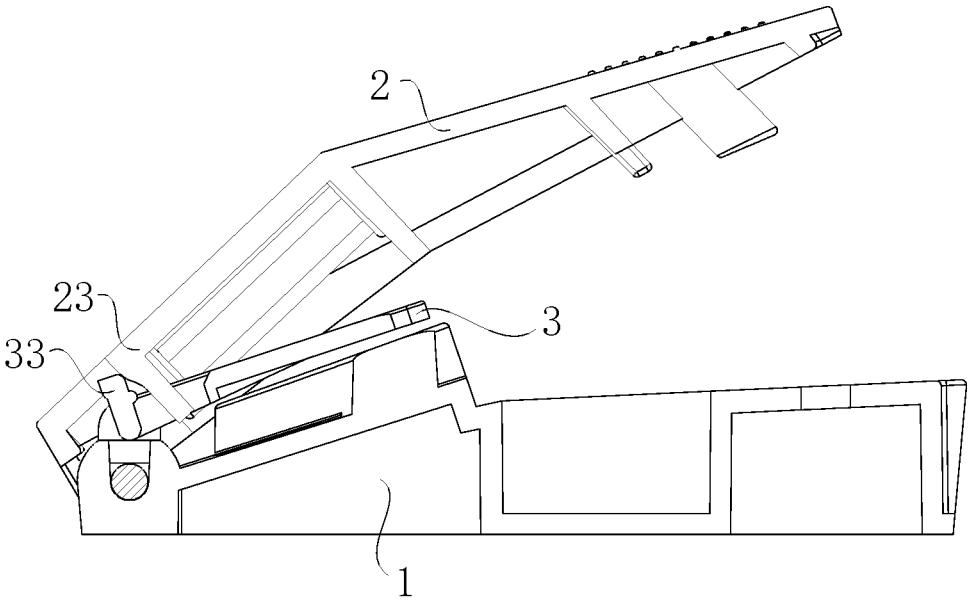
FIG. 14 is a section view along a section line B-B in FIG. 10 of the pill cutter in a first rotation stage.

FIG. 13 is a section view along a section line A-A in FIG. 10 of the pill cutter in a first rotation stage. FIG. 14 is a section view along a section line B-B in FIG. 10 of the pill cutter in a first rotation stage. As shown in FIG. 13 and FIG. 14, when the pill cutter is opened by rotating the pressing plate 2 relative to the bottom case 1, as the rotation angle of the pressing plate 2 relative to the bottom case 1 increases, the pressing plate 2 firstly rotates alone relative to the bottom case 1 until the rotation angle is larger than or equal to the preset angle, as the first gap C decreases, the first space 5 is formed between the pressing plate 2 and the shield plate 3. After the first driving portion 22 abuts the first contacting portion 32, the pressing plate 2 abuts and drives the shield plate 3, then the pressing plate 2 and the shield plate 3 rotate synchronously and respectively around two different rotating shafts.

Figure 15:
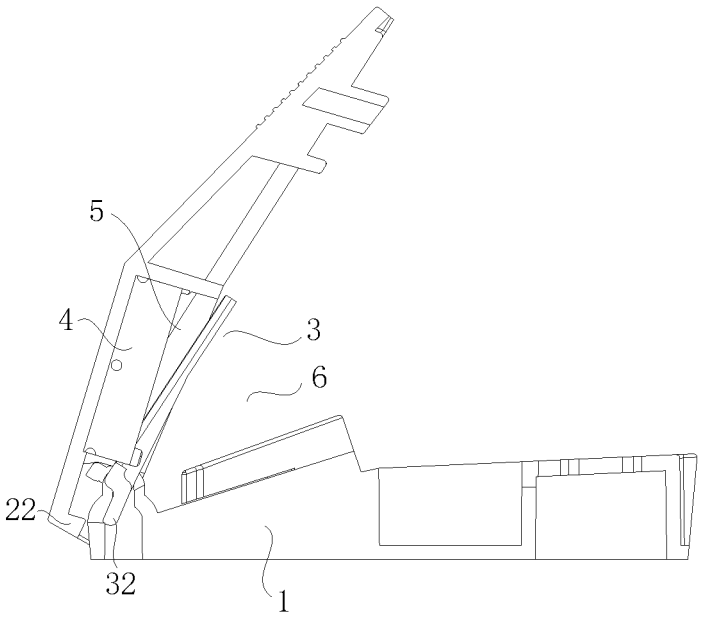
FIG. 15 is a section view along a section line A-A in FIG. 10 of the pill cutter in a second rotation stage.
Figure 16:
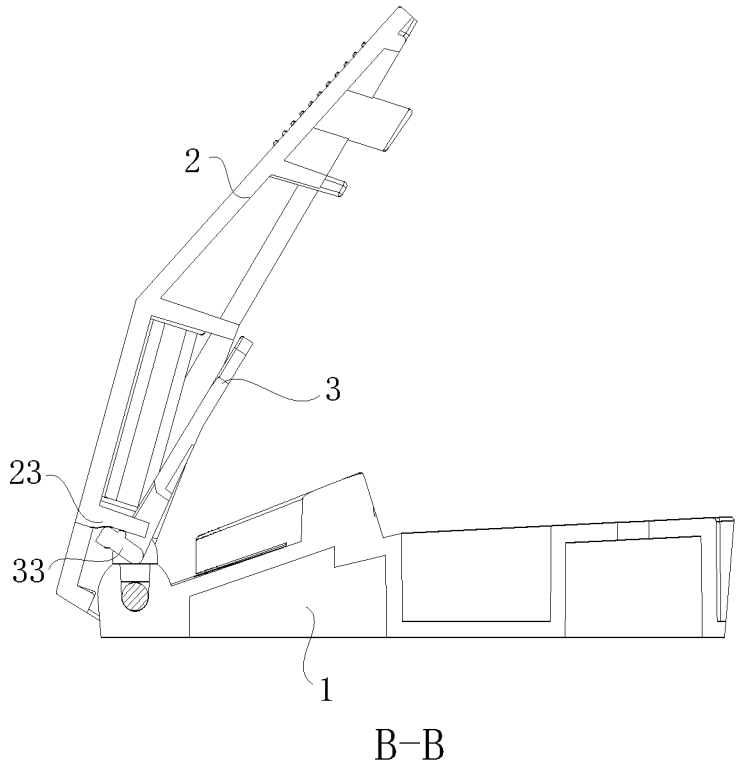
FIG. 16 is a section view along a section line B-B in FIG. 10 of the pill cutter in a second rotation stage.

FIG. 15 is a section view along a section line A-A in FIG. 10 of the pill cutter in a second rotation stage. FIG. 16 is a section view along a section line B-B in FIG. 10 of the pill cutter in a second rotation stage. As shown in FIG. 15 and FIG. 16, as the rotation angle of the pressing plate 2 relative to the bottom case 1 further increases, and the second driving portion 23 abuts the second contacting portion 33, the first space 5 further becomes larger, when the second driving portion 23 abuts the second contacting portion 33, the first driving portion 22 is separated from the first contacting portion 32. The pressing plate 2 continues to drive the shield plate 3 to rotate synchronously around a different rotating shaft, the first space 5 further increases, and a larger part of the blade 4 is accommodated in the first space 5.

Figure 17:
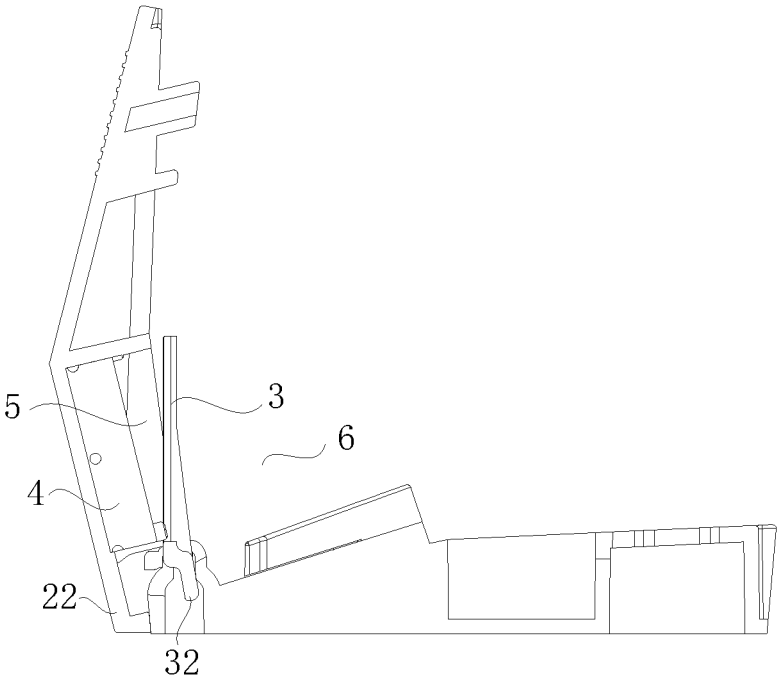
FIG. 17 is a section view along a section line A-A in FIG. 10 of the pill cutter in the protected state.
Figure 18:
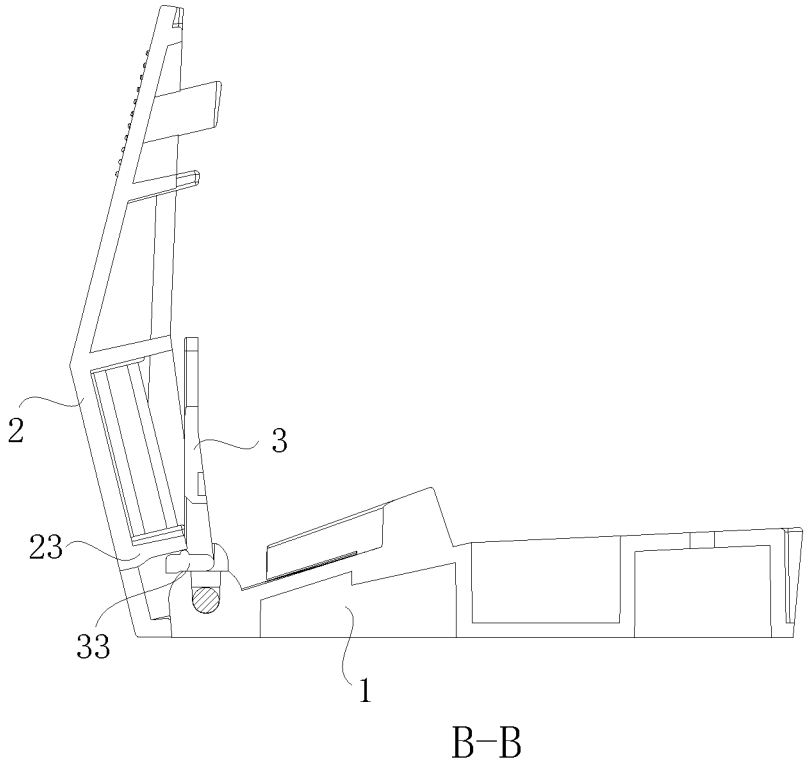
FIG. 18 is a section view along a section line B-B in FIG. 10 of the pill cutter in the protected state.

FIG. 17 is a section view along a section line A-A in FIG. 10 of the pill cutter in the protected state. FIG. 18 is a section view along a section line B-B in FIG. 10 of the pill cutter in the protected state. As shown in FIG. 17 and FIG. 18, as the rotation angle of the pressing plate 2 relative to the bottom case 1 is the largest angle, the pill cutter is completely opened. At this time, the end portion G of the slot opening of the accommodation slot 27 furthest from the pressing plate 2 returns to the accommodation slot 27, the shield plate 3 cannot reach the accommodation slot 27, therefore the blade (not shown in FIG. 17 and FIG. 18) won't be exposed from the slit 31, so that the blade 4 is in the protected state. The blade 4 is integrally accommodated in the first space 5 between the pressing plate 2 and the shield plate 3, the shield plate 3 isolates the first space 5 and the second space 6 for putting the pill in. The user's hand puts the pill only in the second space 6 and cannot touch the blade accommodated in the first space 5, therefore, the user's hand won't be hurt by the cutter in the first space 5. The blade can be taken in the first space automatically to be prevented from scratching the user, therefore, and the safety of the pill cutter is largely enhanced.

On the contrary, the process of the pill cutter returning to the pill-cutting state from the opened protected state includes the following steps: after the user puts the pill on the positioning platform 13, the pill cutter is operated to go through the four states in a sequence opposite to the sequence shown in FIGS. 11-12, FIGS. 13-14, FIGS. 15-16, FIGS. 17-18. That is, the pill cutter goes through the protected state, the second rotation stage, the first rotation stage and the pill-cutting state in sequence. The moving relationship between related components won't be described here.

Besides, during the process of pressing down the pressing plate 2, the shield plate 3 can firstly reach the pill, and the shield plate 3 cooperates with the positioning platform 13 to clamp the pill, to prevent the pill from rolling. When the pill is clamped, the blade 4 passes through slit 31 of the shield plate 3 to cut the pill.

Figure 19:
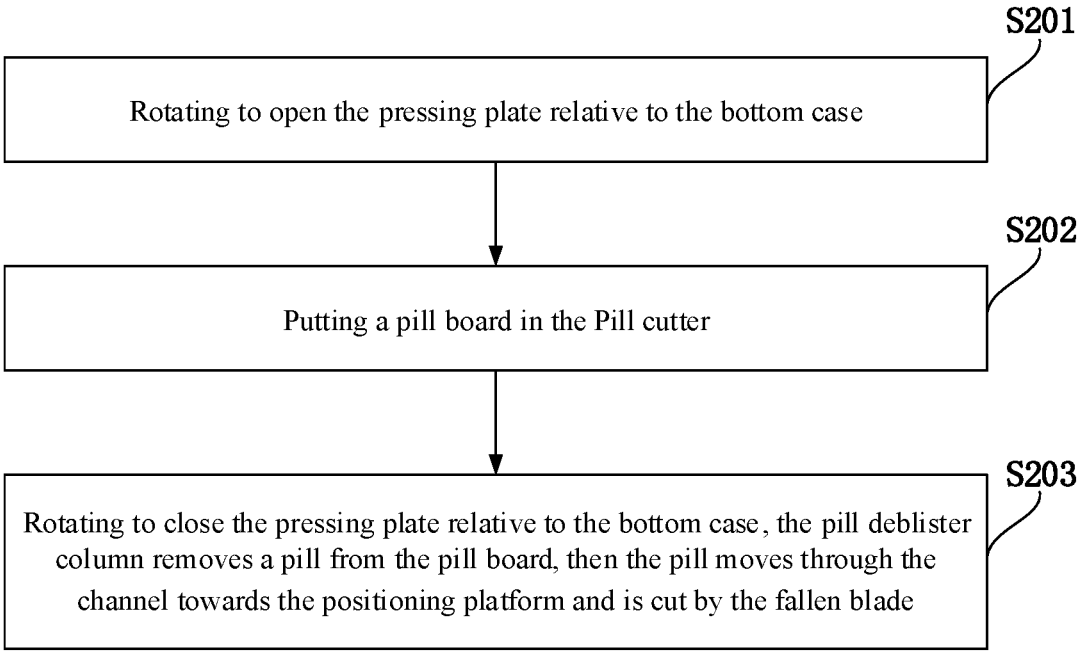
FIG. 19 is a flow chart of another kind of method for using the pill cutter.
Figure 20:
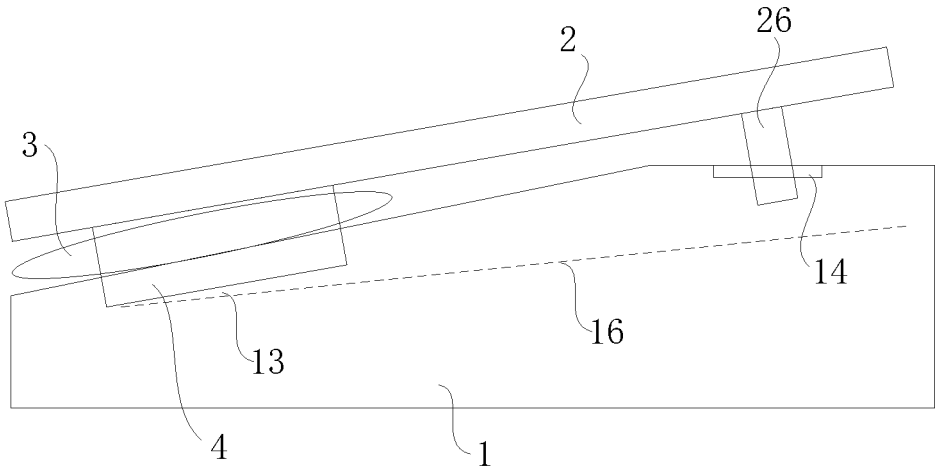
FIGS. 20-24 are schematic views of the steps of another kind of method for using the pill cutter.
Figure 21:
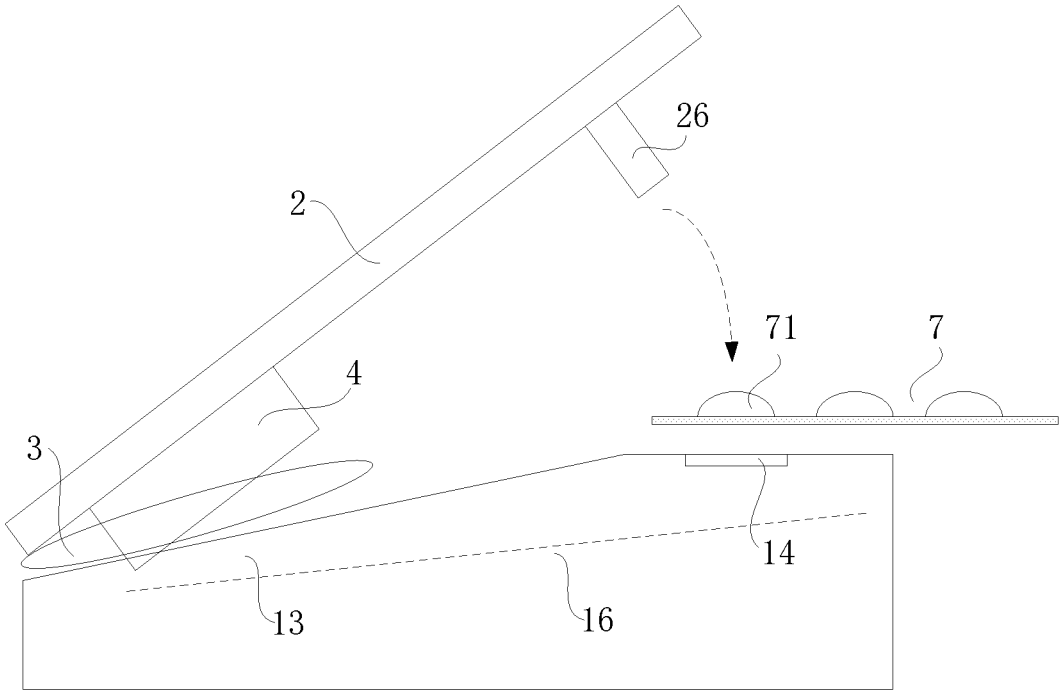
Figure 22:
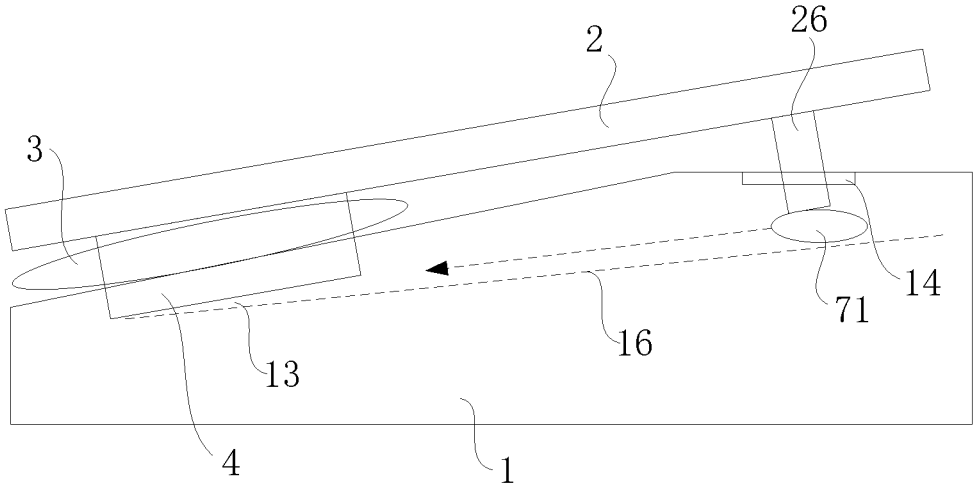
Figure 23:
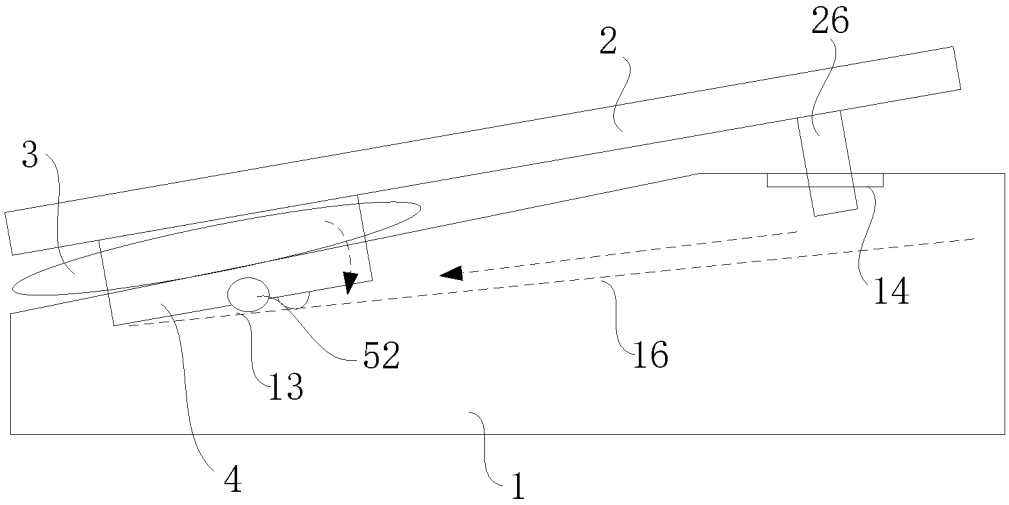

FIG. 19 is a flow chart of another kind of method for using the pill cutter. As shown in FIG. 19, the method for using the pill cutter includes the following steps:

S201: rotating to open the pressing plate relative to the bottom case;

S202: putting a pill board in the bottom case: and

S203: rotating to close the pressing plate relative to the bottom case, the pill deblister column removes (deblisters and separates) a pill from the pill board, the pill moves through the channel towards the positioning platform and is cut by the fallen blade.

Therefore, the pill deblister operation and the pill-cutting operation are unified, and can be accomplished by one closing action, contact opportunities between the user and the pill are largely reduced.

FIGS. 20-24 are schematic views of the steps of another kind of method for using the pill cutter. As shown in FIGS. 20-23, firstly the pressing plate 2 is rotated to open relative to the bottom case 1. Then, the pill board 7 is put in the pill cutter, and the position of the pill cutter 7 is adjusted, so that the pill 71 to be removed (deblistered) is positioned between the pill deblister column 26 of the pressing plate 2 and the pill deblister hole 14 of the bottom case 1. The pressing plate 2 is rotated for a single pressing, to close the pressing plate 2 relative to the bottom case 1. During the process, the pill deblister column 26 firstly cooperates with the pill deblister hole 14, to press the pill 71 out of the pill board 7. The pill 71 passes through the pill deblister hole 14 and falls into the channel 16. Then after the pill 71 slides from a slope of the channel towards the positioning platform 13 at a lower position (a lower position along the gravity direction) under the function of gravity, the pill 71 is cut by the blade 4 on the fallen pressing plate 2, the pill 72 which has been cut stays on the positioning platform 13.

In another alternative embodiment, after the pill 71 is removed (deblistered) manually by the cooperation between the pill deblister column 26 and the pill deblister hole 14 during a first time rotating and pressing, the pill 71 is put on the positioning platform 13 by the user's hand. Then the pill 71 is cut by the blade 4 during a second time rotating and pressing. That is, during the first time rotating and pressing, only the pill deblister column 26 and the pill deblister hole 14 have effective functions, the blade 4 has no actual function. During the second time rotating and pressing, the blade 4 and the positioning platform 13 cooperate to cut the pill 71, the pill deblister column 26 and the pill deblister hole 14 have no actual functions. But the present disclosure is not limited to this.

Figure 24:
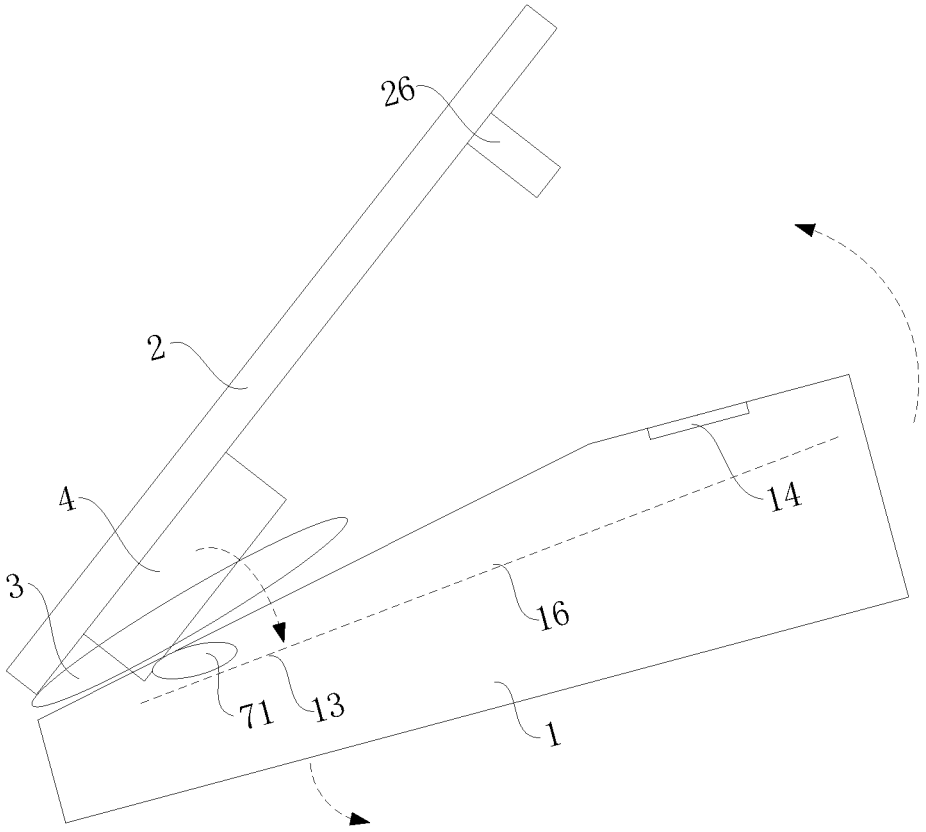

As shown in FIG. 24, in an alternative embodiment, the pill cutter can be inclined manually by the user, to help the pill to slide towards the positioning platform 13 along the channel 16, but the present disclosure is not limited to this.

Above all, in the present disclosure, the blade can be shielded automatically when the pill cutter is opened for putting the pill in, the blade is prevented from being exposed and scratching the user, and the safety of using the pill cutter is largely enhanced. Besides, the pill deblister operation and the pill-cutting operation are unified, and can be accomplished by one closing action, contact opportunities between the user and the pill are largely reduced.

The above is a detailed description of the present disclosure in connection with the specific preferred embodiments, and the specific embodiments of the present disclosure are not limited to the description. Modifications and substitutions can be made without departing from the spirit and scope of the present disclosure.

What is claimed is:

1. A pill cutter used for cutting pills, comprising:

a bottom case;

a pressing plate, rotatably connected to the bottom case and provided with a blade; and a shield plate, rotatably connected to the bottom case and provided with a slit;

wherein, the shield plate is located between the pressing plate and the bottom case, such that when the pressing plate rotates relative to the bottom case, the pressing plate cooperates with the shield plate, so that the blade at least has a protected state and a pill-cutting state, wherein, in the protected state, the blade is positioned between the shield plate and the pressing plate after the pressing plate and the shield plate are separated from each other, and in the pill-cutting state, the blade passes through the slit and reaches the bottom case;

wherein, a first pivoting portion and a second pivoting portion are provided on a first end of the bottom case;

a first end of the pressing plate is rotatably connected to the first pivoting portion through a first rotating shaft, the first end of the pressing plate is provided with a first driving portion and a second driving portion, and the first driving portion is closer to the first end of the pressing plate than the second driving portion;

a first end of the shield plate is rotatably connected to the second pivoting portion through a second rotating shaft, the first end of the shield plate is provided with a first contacting portion and a second contacting portion, and the first contacting portion is closer to the first end of the shield plate than the second contacting portion;

during a first rotation stage of the pressing plate relative to the bottom case, the first driving portion abuts the first contacting portion to drive the shield plate to rotate around the second rotating shaft;

during a second rotation stage of the pressing plate relative to the bottom case, the second driving portion abuts the second contacting portion to drive the shield plate to rotate around the second rotating shaft;

wherein, in the pill-cutting state, a first gap is formed between the first driving portion and the first contacting portion so the first driving portion is not in contact with the first contacting portion, and a second gap is formed between the second driving portion and the second contacting portion, so the second driving portion is not in contact with the second contacting portion; and as a rotation angle between the pressing plate relative to the bottom case increases, the first gap decreases until the first driving portion abuts the first contacting portion, and the second gap decreases until the second driving portion abuts the second contacting portion.

2. The pill cutter of claim 1, wherein, when the pressing plate rotates relative to the bottom case, the pressing plate cooperating with the shield plate comprises the pressing plate rotating alone in a first cooperation state, and the shield plate rotating together with the pressing plate in a second cooperation state.

3. The pill cutter of claim 2, wherein, when the pressing plate rotates alone relative to the bottom case and a rotation angle thereof is smaller than a preset angle, the shield plate stays static relative to the bottom case;

when the pressing plate rotates alone relative to the bottom case and the rotation angle thereof is larger than or equal to the preset angle, the pressing plate abuts and drives the shield plate, such that the pressing plate and the shield plate rotate synchronously and respectively around the first rotating shaft and the second rotating shaft, respectively.

4. The pill cutter of claim 1, wherein, the pressing plate is provided with a side wall, the side wall and at least a part of the pressing plate together form an accommodation slot for accommodating the shield plate in the pill-cutting state.

5. The pill cutter of claim 4, wherein, the accommodation slot has a slot opening and an end portion, the end portion is a furthest portion of the slot opening from the first rotating shaft of the pressing plate, an effective opening length of the accommodation slot is a distance from the end portion to an axle center of the second rotating shaft of the shield plate;

when the effective opening length is larger than a length of the shield plate, the shield plate is capable of passing through the slot opening to enter or exit from the accommodation slot;

during at least a part of the first or second rotation stage of the pressing plate relative to the bottom case, as the rotation angle of the pressing plate relative to the bottom case increases, the effective opening length decreases.

6. The pill cutter of claim 5, wherein, in the protected state, the effective opening length is smaller than the length of the shield plate, and the end portion blocks the shield plate from returning to the accommodation slot.

7. The pill cutter of claim 1, wherein, a first space is formed between the pressing plate and the shield plate, and a second space is formed between the shield plate and the bottom case;

in the protected state, the blade is integrally accommodated in the first space;

in the pill-cutting state, at least a part of the blade enters the second space from the first space through the slit.

8. The pill cutter of claim 1, wherein, an angle between the pressing plate and the bottom case during the first rotation stage is smaller than an angle between the pressing plate and the bottom case during the second rotation stage.

9. The pill cutter of claim 1, wherein, when the second driving portion abuts the second contacting portion, the first driving portion and the first contacting portion are separated from each other; or when the first driving portion abuts the first contacting portion, the second driving portion and the second contacting portion are separated from each other.

10. The pill cutter of claim 1, wherein, the pressing plate is provided with an accommodation slot for accommodating the shield plate in the pill-cutting state, the accommodation slot has a slot opening and an end portion, the end portion is a furthest portion of the slot opening from the first rotating shaft;

the second rotating shaft is located within an area centered on the first rotating shaft, and a radius of the area is equal to a distance from the end portion to the first rotating shaft.

11. The pill cutter of claim 1, wherein, the slit extends from a second end of the shield plate towards the first end of the shield plate.

12. The Dill cutter of claim 1, wherein, the pressing plate has a second end departing from the first rotating shaft of the pressing plate, and the second end of the pressing plate is provided with a pill deblister column;

the bottom case has a second end departing from the first pivoting portion, and the second end of the bottom case is provided with a pill deblister hole used for the pill deblister column going through.

13. The pill cutter of claim 12, wherein, the bottom case is further provided with a channel, the channel connects a lower part of the pill deblister hole and a positioning platform.

14. The pill cutter of claim 13, wherein, the channel inclines from the lower part of the pill deblister hole towards the positioning platform, to guide the pills to move towards the positioning platform.

15. A method for using the pill cutter of claim 13, comprising the following steps:

rotating to open the pressing plate relative to the bottom case;

putting a pill board in the pill cutter; and rotating to close the pressing plate relative to the bottom case once, the pill deblister column removes a pill from the pill board, then the pill moves through the channel towards the positioning platform and is cut by the blade in the pill-cutting state.

16. A method for using the pill cutter of claim 1, comprising the following steps:

rotating to open the pressing plate relative to the bottom case, wherein, as the pressing plate rotates relative to the bottom case, the shield plate is separated from the pressing plate, and the blade is positioned between the shield plate and the pressing plate;

putting at least one pill in the pill cutter; and rotating to close the pressing plate relative to the bottom case, and the blade passes through the slit of the shield plate to cut the pill.

* * * * *